United States Patent [19]

Favell

[11] 4,011,962

[45] Mar. 15, 1977

[54] TWO PIECE CLOSURE FOR CONTAINERS

[75] Inventor: Donald George Favell, Hamden, Conn.

[73] Assignee: VCA Corporation, Baton Rouge, La.

[22] Filed: June 1, 1976

[21] Appl. No.: 691,243

[52] U.S. Cl. ..... 215/334

[51] Int. Cl.[2] ..... B65D 41/04

[58] Field of Search ..... 215/316, 334; 220/288

[56] References Cited

UNITED STATES PATENTS

| | | | |
|---|---|---|---|
| 2,133,298 | 10/1938 | Kaufman | 220/288 |
| 2,233,105 | 2/1941 | McCombs | 215/334 |

*Primary Examiner*—Donald F. Norton

*Attorney, Agent, or Firm*—Donald L. Johnson; John F. Sieberth; Edgar E. Spielman, Jr.

[57] ABSTRACT

A two-piece closure for containers having a metal outer cap and an inner cap fixedly positioned within the outer cap is disclosed. The outer metal cap has a top wall integrally formed with an annular downwardly depending sidewall, the sidewall having a smooth, rounded edge formed by a U-shaped fold of a thin portion of the sidewall which portion is of such a thickness that said fold has a thickness approximately equal to the thickness of that portion of the sidewall adjacent to the thin portion. The inner cap can be any conventional cap which can be fixed inside the metal overcap and which has attaching structure for attaching the closure to the container.

10 Claims, 12 Drawing Figures

TWO PIECE CLOSURE FOR CONTAINERS

BACKGROUND OF THE INVENTION

In the highly competitive cosmetic industry, proper packaging of the product is very important. The industry desires a package which is handsome and elegant to convey to the consumer the sense of elegance and luxurousness associated with the product.

Generally speaking, the cosmetic product is packaged in a brightly colored container having a screw top closure. To overcome the rather stark appearance of the conventional, continuous thread closures, the industry has found it necessary to utilize two-piece closures. These two-piece closures usually consist of an inner cap which has a helical thread about the inside wall of the sidewall of the inner cap and an outer cap which surrounds the inner cap and an which has eye-pleasing characteristics. The outer cap is most normally metal so that a metallic gold or silver color can be used to give the desired impression.

Since a conventional punch and die process is used to form the outer cap, a rough, unfinished outer edge on the sidewall of the outer cap is present. Besides the problems of preventing cuts to the hand from such an edge, there are closure-container assembly problems associated with such a closure. When assembling the container and closure the closure may be put into a vibrating hopper unscrambler which causes the closures to vibrate and therefore movably contact one another so that the rough edges of the outer cap contact the outer wall surfaces of the other closures which contact causes scarring of the closure finish. Such scarring is obviously undesirable as the esthetically pleasing appearance is ruined. Another disadvantage of the above conventional types of two-piece closures is that the sharp edge will oftentimes cut into the container should the closure be screwed down to tight onto the container.

Therefore, it is an object of this invention to provide a two-piece closure which does not have any sharp edges which would cut the user's hands, cause scarring during assembly or damage the container on which it is used.

THE INVENTION

This invention relates to a two-piece closure for containers featuring a metal outer cap having a top wall integrally formed wth an annular downwardly depending sidewall, the sidewall having a smooth, rounded edge formed by a U-shaped fold of a thin portion of the sidewall which portion is of such a thickness that the fold has a thickness approximately equal to the thickness of that portion of the sidewall adjacent to the thin portion and an inner cap fixed within the outer cap, the inner cap having a top wall integrally formed with an annular downwardly depending sidewall, and an attaching means for attaching the closure to the container.

In a preferred form the two-piece closure of this invention features the thin portion having a thickness of about one-half of the thickness of the adjacent portion. When best esthetic effect is preferable the U-shaped fold can made towards the inside of the outer cap. With the U-shaped fold being made to the inside, the inside of the sidewall will be an approximate planar surface.

To simplify manufacture it has been found preferable to have a sloping wall connect the adjacent portion to the thin portion and to have the edge of the thin portion slanted in such a manner that when the U-shaped fold is made the slanted edge and the sloped wall will fit snugly together.

Besides providing an inner cap having no sharp edges, the outer cap of this invention is also highly versatile as it is compatable with different types of inner caps. The prior art generally features a metallic outer cap and a metallic inner cap which inner cap is of the general continuous thread type. Utilizating the outer cap of this invention the conventional continuous thread type cap can be used but the plastic caps are also very suitable. When the plastic inner cap is utilized it can be attached to the outer cap by gluing the two caps together.

These and other features of the invention contributing satisfaction in use and economy in manufacture may be more fully understood from the following description of a preferred embodiment of the invention when taken in connection with the accompanying drawings in which identical numerals refer to identical parts and in which:

FIGS. 5A–8A are sectional views taken through respective section lines in FIGS. 5–8.

Figure 1:
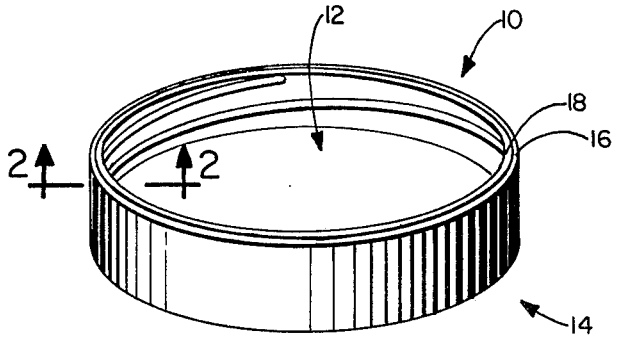
FIG. 1 is a perspective view of a closure of this invention.
Figure 2:
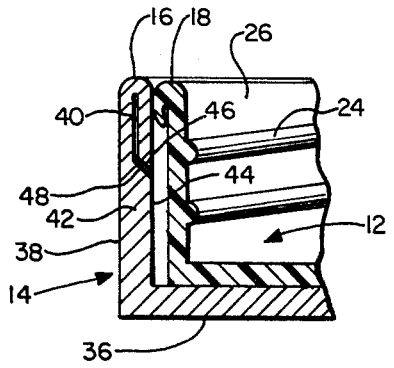
FIG. 2 is a sectional view taken along section lines 2—2 of FIG. 1.

Referring now to FIGS. 1 and 2, it can be seen that a two-piece closure of this invention, generally designated by the numeral 10, has an inner cap, generally designated by the numeral 12, which is nested within an overcap, generally designated by the numeral 14. Inner cap 12 stays in rigid contact with outer cap Inner cap 12 stays in rigid contact with outer cap 14 which contact is achieved by force-fitting inner cap 12 within outer cap 14. As is shown in FIG. 1, the particular embodiment depicted has edge 18 of inner cap 12 and edge 16 of outer cap 14 being approximately the same height. If desired, however, edge 18 of inner cap 12 may be in a somewhat lower position as the need may arise. For example, inner cap 12 may be substantially shorter in height than outer cap 14 with the use of such a combination being highly effective when used on long necked containers.

Figure 3:
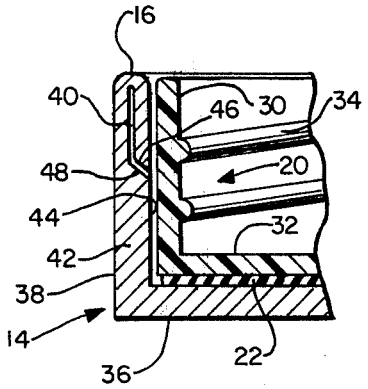
FIG. 3 is the same sectional view as shown in FIG. 2 except that the inner cap is a plastic cap.

Cap 14 is a metal cap while inner cap 12 is generally, for economic reasons, also of metal. Inner cap 12, however, may be of ay suitable material, as for example it can be made of plastic as is depicted in FIG. 3. In FIG. 3 the inner plastic cap is designated by the numeral 20. Inner plastic cap 20 is attached to outer cap 14 by simply gluing the two together. The glue line 22 is shown in FIG. 3.

As seen in FIG. 2, inner cap 12 is a conventional, continuous thread metal cap having continuous helical threads 24 which are carried by the inside of inner cap sidewall 26. Inner cap sidewall 26 is attached to inner cap top wall 28 at one end and terminates at the other end into edge 18. Edge 18 is a rounded edge and is formed simply by turning back a portion of inner cap sidewall 26. The diameter of inner cap 12 including the turned back portion of inner cap sidewall 26 should be such that it will provide a force fit within outer cap 14 to insure rigid connection between the two caps.

As mentioned previously, FIG. 3 shows a closure of this invention having a plastic inner cap. As can be seen, plastic inner cap 20 has inner plastic sidewall 30 which is attached to inner plastic top wall 32. Plastic helical threads 34 mounted on plastic inner cap sidewall 30 are for attachment of the closure to the container. The edge of plastic inner cap sidewall 30 is smooth. The rounded and smooth appearance at the edge is achieved simply by molding techniques.

Figure 4:
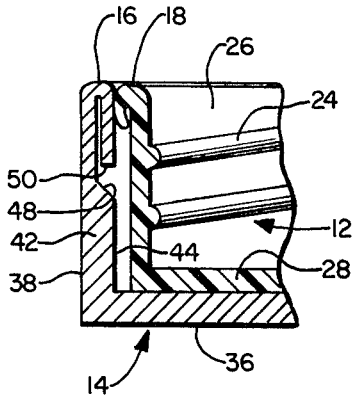
FIG. 4 is the same sectional view as shown in FIG. 2 except that a different U-shaped fold is depicted.

Referring now to FIGS. 1, 2 and 4, it can be seen that outer cap 14 has a top wall 36 which is attached to one end of outer cap sidewall 38. Outer cap sidewall 38 has a thin portion 40 which is adjacent to thicker portion 42. Rounded edge 16 of outer cap sidewall 38 is accomplished by forming a U-shaped fold in thin portion 40. Since a U-shaped fold results in a doubling of thickness of the sidewall at the fold it is necessary, to achieve a continuous, smooth inner surface, for outer cap sidewall 38 to have thin portion 40 of a thickness which is approximately ½ the thickness of adjacent portion 42. If such a continuous smooth inner surface is not necessary or desired thin portion 40 can be less than ½ of the thickness of adjacent portion 42.

When it is desired to obtain an extremely smooth surface for the inside wall of outer cap sidewall 38, the terminal edge 46 of thin portion 40 is cut so that it forms an angle approximately equal to the angle of optional sloping wall 48 which connects the inner walls of thin portion 40 and adjacent portion 38.

A different treatment of the terminal edge of thin portion 40 is shown in FIG. 4. Note that the terminal edge 50 in FIG. 4 is not angled but rather is a square cut. Such a square cut can be suitable in some instances, however, there will be a loss of continuity between sloped wall 48 and terminal edge 50. Such a loss of continuity in some applications, however, will be of little consequence.

The formation of outer cap 14 can be achieved by utilization of conventional equipment. FIGS. 5–8 and 5A–8A depict various stages of formation for outer cap 14. It should be pointed out that the particular outer cap shown in these drawings is one in which the inner cap would be much shorter than the overcap and would be nested up in the outer cap near the outer cap top wall. Such a closure would be particularly suitable for utilization on long necked containers where it is desired to have a closure covering the long neck without having to have the long neck completely threaded from top to bottom.

Figure 5:
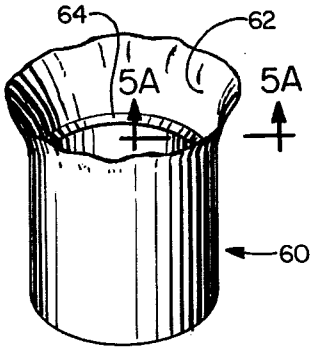
Figure 5A:
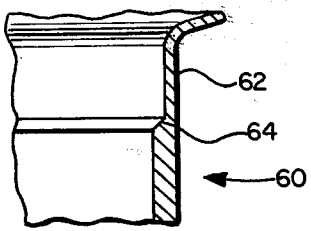

FIGS. 5 and 5A show outer cap 60 after it has been through a conventional blanking and cupping operation. At this point outer cap 60 is placed into a die which is receptive of a punch which punch, when placed within the die, forms thin portion 62 and sloping wall 64. Sloping wall 64 and thin portion 62 correspond to sloping wall 48 and thin portion 40 which are shown in FIGs. 1–4. Waste material W is then removed from thin portion 62 while at the same time terminal end 66 is also formed. The terminal end 66 corresponds to terminal end 46 for the outer cap shown in FIGS. 1–4. Removal of waste W and formation of terminal end 66 is achieved by utilization of a pinch trim which is well-known in the art. As pointed out previously, the formation of a square cut is possible and such a cut is shown in FIG. 4.

Figure 8:
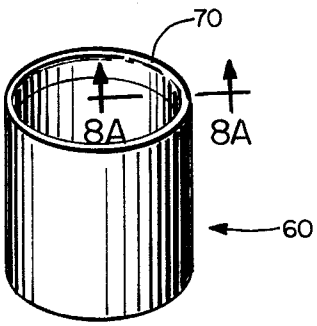
FIGS. 5–8 are perspective views showing an outer cap of this invention in different stages of manufacture.
Figure 8A:
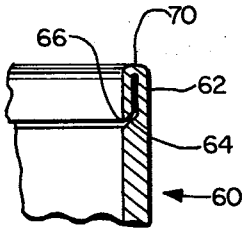
Figure 7:
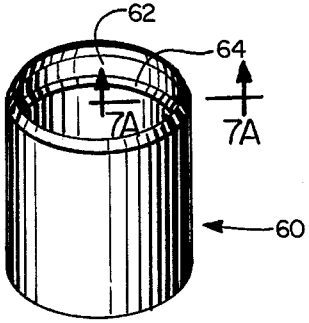
Figure 7A:
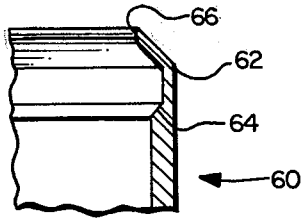
Figure 6:
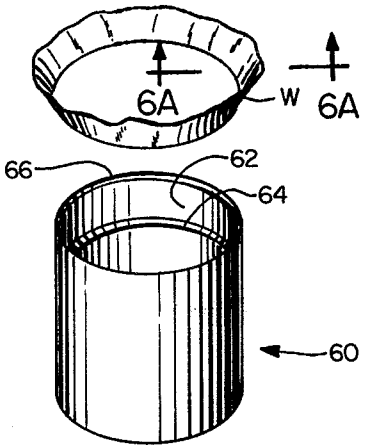
Figure 6A:
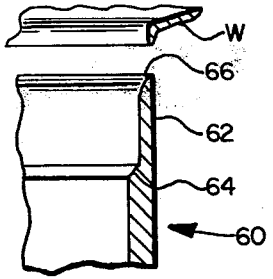

FIGS. 7 and 7A depict the result of a conventional coning operation which is the start of the formation of the U-shape. FIGS. 8 and 8A show the results after the overcap 60 is run through a second die and punch operation to finish the U-shaped fold to give rounded edge 70. Rounded edge 70 is identical to the rounded edge 22 shown in FIGS. 1–4. After this operation no further finishing of terminal edge 70 is required and the outer cap 60 is ready for receipt of an inner cap.

It has been found that the outer caps of this invention are best made of ductile metals which are easily workable. Preferred metals are the ferrous metals. A most preferred metal is aluminum and various alloys thereof.

What is claimed:

1. A two-piece closure for containers comprising:

a. a metal outer cap having a top wall integrally formed with an annular downwardly depending side wall, said side wall having a smooth, rounded edge formed by a U-shaped fold of a thin portion of said side wall which portion is of such a thickness that said fold has a thickness approximately equal to the thickness of that portion of said side wall adjacent to said thin portion; and, b. an inner cap fixed within said outer cap, said inner cap having a top wall integrally formed with an annular downwardly depending side wall, and an attaching means for attaching said closure to said container.

2. The closure of claim 1 wherein said thin portion has a thickness of about one half of the thickness of said adjacent portion.

3. The closure of claim 2 wherein said U-shaped fold is a fold made to the inside of said outer cap.

4. The closure of claim 3 wherein said thin portion and said adjacent portion are attached one to the other by an annular sloping wall and wherein the terminal edge of said thin portion is cut at an angle approximately equal to the angle formed by a horizontal plane and said sloping wall.

5. The closure of claim 4 wherein said inner cap is a metal cap.

6. The closure of claim 4 wherein said inner cap is a plastic cap.

7. The closure of claim 1 wherein said U-shaped fold is a fold made to the inside of said outer cap.

8. The closure of claim 1 wherein said thin portion and said adjacent portion are connected one to the other by means of an annular sloping wall.

9. The closure of claim 8 wherein the terminal edge of said thin portion is cut at an angle approximately equal to the angle formed by a horizontal plane and said sloping wall.

10. The closure of claim 1 wherein said attaching means is a continuous helical thread on the inside wall of said side wall of said inside cap.

* * * * *

UNITED STATES PATENT OFFICE

CERTIFICATE OF CORRECTION

Patent No. 4,011,962 Dated March 15, 1977

Inventor(s) Donald George Favell

It is certified that error appears in the above-identified patent and that said Letters Patent are hereby corrected as shown below:

Column 1, line 18, "and an which" should read -- and which --

Column 1, line 65, "can made" should read -- can be made --

Column 2, line 43, after "outer cap" insert -- 14. --.

Column 2, line 57, "ay" should read -- any --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*